United States Patent [19]

Horikoshi et al.

[11] 4,358,642

[45] Nov. 9, 1982

[54] ELECTRO-MAGNETIC TYPE ELECTRIC ACOUSTIC TRANSDUCER

[75] Inventors: Ichiro Horikoshi; Shigeo Mori; Fumikazu Murakami; Yoshiaki Hara; Susumu Fujita, all of Tokyo, Japan

[73] Assignee: Kabushiki Kaisha Daini Seikosha, Japan

[21] Appl. No.: 973,590

[22] Filed: Dec. 27, 1978

[30] Foreign Application Priority Data

Dec. 29, 1977 [JP] Japan ..... 52-159287

[51] Int. Cl.[3] ..... H04R 19/18

[52] U.S. Cl. ..... 179/115.5 R

[58] Field of Search ..... 179/114 R, 115 R, 180

[56] References Cited

U.S. PATENT DOCUMENTS

| | | | |
|---|---|---|---|
| 1,486,081 | 3/1924 | Fischer | 179/115 R |
| 1,536,486 | 5/1925 | Fischer | 179/115 R |
| 1,698,407 | 1/1929 | Johnson | 179/115 R |
| 2,390,794 | 12/1975 | Knight | 179/115 R |
| 3,324,253 | 6/1967 | Uemura et al. | 179/115 R |

*Primary Examiner*—James W. Moffitt

*Attorney, Agent, or Firm*—Robert E. Burns; Emmanuel J. Lobato; Bruce L. Adams

[57] ABSTRACT

An electro-magnetic type electric acoustic transducer comprising an exciting portion consisting of a back plate mounting a permanent magnet and a magnetic core winding an exciting coil therearound, a vibrating plate arranged opposite to said exciting portion leaving a certain space, and a vibrating plate supporting member which supports the periphery of said vibrating plate, characterized in that the resonance frequency of the vibrating plate is reduced while maintaining sound pressure by providing an air hole at a part of said plate or said vibrating plate supporting member.

4 Claims, 4 Drawing Figures

ELECTRO-MAGNETIC TYPE ELECTRIC ACOUSTIC TRANSDUCER

BACKGROUND OF THE INVENTION

The present invention relates to a means for reducing the resonance frequency of the vibrating plate of an electro-magnetic acoustic transducer (hereafter referred to as "transducer").

A construction of a conventional transducer is shown in FIG. 1. An exciting portion is composed of a permanent magnet 5 and an exciting coil 6 mounted on back plate 7 including a magnetic core 7*a* and housed in a vibrating plate supporting member 3. The periphery of a vibrating plate 2 arranged opposite to the exciting portion and formed in one body with a yoke 1 by welding or the like is supported by the vibrating plate supporting member 3 having the vibrating plate support diameter D. In the conventional construction, the vibrating plate support diameter D is increased or the volume of the yoke 1 is enlarged in order to reduce the resonance frequency without reducing the sound pressure when the resonance frequency of the vibrating plate 2 is high. However, the above means is disadvantageous since the shape of the transducer is enlarged and the thickness thereof is increased.

It is an object of the present invention to obtain a transducer provided with a sufficient sound pressure by reducing the resonance frequency stably without enlarging the shape of the transducer.

In accordance with the invention, an air hole is provided which opens into the space defined by the back plate, vibrating plate and vibrating plate support member and the air hole is sufficiently large to reduce the resonant frequency of the vibrating plate while maintaining the sound pressure in such space.

Figure 1:
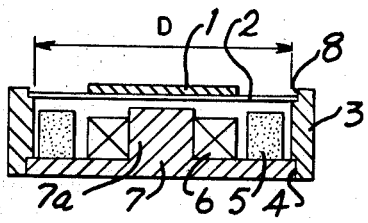
FIG. 1 PRIOR ART
FIG. 1 is a sectional view showing the construction of conventional transducer.

An embodiment of the present invention will be described in conjunction with the drawing.

Figure 2:
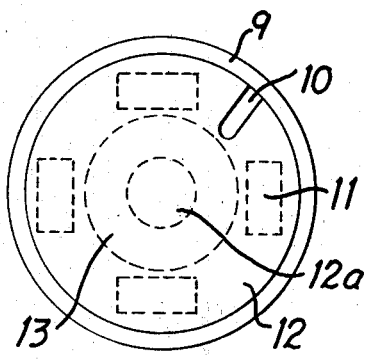
FIG. 2 is a plan view showing the exciting portion of a transducer according to the present invention.

FIG. 2 is a plan view of a transducer with the vibrating plate removed therefrom according to an embodiment of the present invention.

The transducer is shown as comprising a vibrating plate supporting member 9 and a back plate 12 on which is provided a magnetic core 12-*a* and a set of permanent magnets 11 and an exciting coil 13 mounted thereon. The feature of the present invention is to provide an air hole 10 as a means to reduce the resonance frequency. The air hole 10 opens into the space enclosed by the back plate 12, the vibrating pulse supporting member 9 and the vibrating plate and is shown by way of example as being formed in the back plate 12. The mounting construction and the sectional view of the vibrating plate and the back plate 12 in FIG. 2 are eliminated since these are the same as that of FIG. 1.

An explanation will now be given as to the reason why the air hole 10 is provided as a means to reduce the resonance frequency of the vibrating plate.

Figure 3:
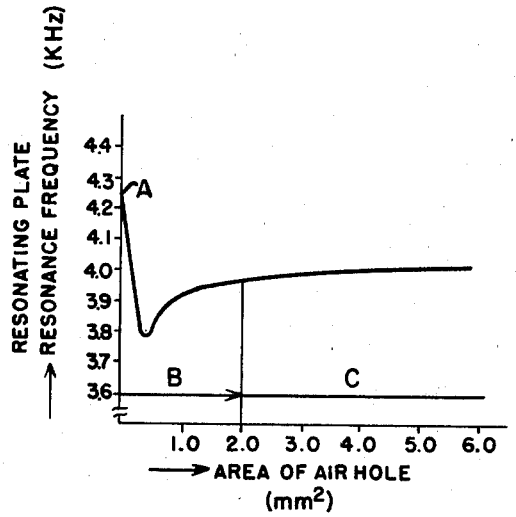
FIG. 3 is a characteristic diagram showing the relation between the rear of the air hole and the resonance frequency of the vibrating plate.

FIG. 3 shows the relation between the resonance frequency of the vibrating plate and the area of the air hole 10 when the area of the air hole 10 provided in the plate 12 is changed.

Figure 4:
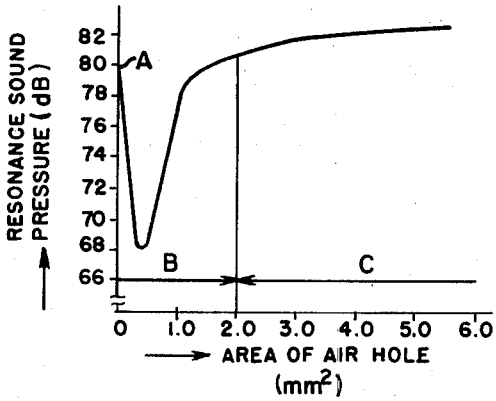
FIG. 4 is a characteristic diagram showing the relation between the area of the air hole and the sound pressure of the resonance similar to FIG. 3.

FIG. 4 shows the relation between the resonance sound pressure and the area of the air hole 10 obtained experimentally. In the experiment, the general size of the transducer is; the outer diameter: 10 mm and the height: 2 mm and the shape of the air hole 10 is almost rectangular and the thickness thereof is about 0.5 mm as shown in FIG. 2. As shown in FIGS. 3 and 4 respectively, if the area of the air hole is gradually increased from the completely sealed state "O" ("A" in FIGS. 3 and 4), both the resonance frequency and the sound pressure respectively fall rapidly in the first place and drop down to a minimum value and then the resonance frequency and the sound pressure increase in accordance with an increase in the area of the air hole, and gradually approaches to almost a fixed value, and ultimately, the value traces an easy grade which is regarded as almost fixed value in case the area of the air hole is more than a predetermined dimension, namely 2 $mm^2$. When the area of the air hole is large enough, the sound pressure recovers a value the same as that of the completely sealed state or more, but the resonance frequency falls without recovering the value of that of the completely sealed state.

The reason why the resonance frequency sound pressure of a transducer provided with the air hole 10 is a function of the area of the air hole as described above in comparison with that of a completely sealed transducer will be now described.

Referring first to the case in which the area of the air hole is sufficiently large. In the area shown by "C" in FIGS. 3 and 4, the sound pressure of the transducer provided with the air hole is almost the same value as that of the transducer completely sealed, however, the resonance frequency of the transducer provided with the air hole is lower than the frequency of the transducer completely sealed. This is because, when the transducer is completely sealed, the closed space provided between the vibrating plate 2, the back plate 7 and the vibrating plate supporting member 3 serves as an air spring and thereby determines the resonance frequency by adding to the spring constant of the vibrating plate 2. On the contrary, the above mentioned air spring is eliminated by the provision of the air hole 10 and thereby the resonance frequency drops.

With respect to the sound pressure of the transducer provided with the air hole, since the influence of the viscous resistance upon the vibration of the vibrating plate in the closed space is not so large, the sound pressure is the same or a little larger than that of the completely sealed transducer.

Referring then to the case in which the area of the air hole is small. In the range B in FIGS. 3 and 4, the resonance frequency and the resonance sound pressure of the transducer provided with a small hole is lower than that of the completely sealed transducer, and further lower than the area "C" where the area of the air hole is sufficiently large. This is because the viscous resistance of air in the air hole is very large. As shown in FIG. 4, the resonance sound pressure of the transducer provided with the small air hole falls drops more than 10 dB in comparison with that of the transducer completely sealed. FIG. 4 shows how the attenuation action against the vibrating plate is severe. The attenuation action is that the air flowing out and in through the air hole 10 by the vibration of the vibrating plate absorbs the vibration energy of the vibrating plate.

In the experiment, the resonance sound pressure is observed to drop most when the area of the air hole is from 0.2 $mm^2$ to 0.7 $mm^2$ and recovers to a value the same as that of the transducer completely sealed when the area of the air hole is about 2 $mm^2$. The area of the air hole according to the present invention is within the range C in FIGS. 3 and 4, where the resonance frequency is reduced to a stable value and the resonance sound pressure is more than the transducer completely sealed. In the area of the air hole within this range, even if dispersion in the area of the air hole occurs, the performance of the transducer does not change and a sufficiently stable transducer can be obtained.

Though a transducer according to the present invention has been described in conjunction with the accompanying drawings, the present invention is not restricted by the embodiment shown but various alterations and improvements are possible such as the provision of the air hole at the side surface of the vibrating plate supporting member.

On the other hand, when the transducer according to the present invention is used, the generation of sound from the air hole comes into question. But it is easily solved by improving the sound-proof structure of the attachment instrument or positively using the sound generated from the air hole.

As described so far, since the transducer according to the present invention is provided with the air hole as a method to reduce the resonance frequency of the vibrating plate, it is possible to make the shape of the transducer smaller in comparison with the transducer completely sealed as mentioned before if the resonance frequency is to be the same. And if the air hole is used as an outlet of the lead wire from the exciting coil, it is not necessary to particularly provide the outlet of the lead wire.

We claim:

1. In a small electro-magnet acoustic transducer having an enclosure defined by a back plate, an annular supporting member on said back plate and a vibrating plate supported at its periphery by said supporting member; and having a permanent magnet, a magnetic core and an exciting coil disposed around said core all mounted in said enclosure, the improvement comprising: means defining an air hole opening from the atmosphere into said enclosure, said air hole being of a size to reduce the resonant frequency of said transducer with respect to a like transducer in which the enclosure is sealed, while maintaining the resonant sound pressure at a value at least equal to that of a like transducer in which the enclosure is sealed.

2. A small electro-magnetic acoustic transducer according to claim 1, in which said air hole is of a size to reduce the resonant frequency to a value at least 6% below that of a like transducer in which the enclosure is sealed.

3. A small electro-magenetic acoustic transducer according to claim 1, in which the area of said air hole is at least approximately 2 $mm^2$.

4. A small electro-magnetic acoustic transducer according to claim 1, in which said enclosure has a resonant frequency substantially greater than the resonant frequency of said vibrating plate.

* * * * *